United States Patent [19]

Bonfiglioli et al.

[11] Patent Number: 4,524,742

[45] Date of Patent: Jun. 25, 1985

[54] CARBURETOR HAVING ELECTRONICALLY CONTROLLED ELEMENTS FOR MAINTAINING ENGINE IDLING SPEED AT A CONSTANT LEVEL AND FOR CONTROLLING CHOKE-VALVE POSITION DURING A WARM-UP PHASE

[75] Inventors: Silverio Bonfiglioli, Zola Predosa; Innocenzo Triolo, Bologna, both of Italy

[73] Assignee: Weber S.p.A., Turin, Italy

[21] Appl. No.: 561,994

[22] Filed: Dec. 16, 1983

[30] Foreign Application Priority Data

Dec. 20, 1982 [IT] Italy ..... 3627 A/82

[51] Int. Cl.[3] ..... F02B 33/00

[52] U.S. Cl. ..... 123/438; 123/339; 261/52; 261/39 R

[58] Field of Search ..... 123/339, 438; 261/39 R, 261/39 C, 52

[56] References Cited

U.S. PATENT DOCUMENTS

| | | | |
|---|---|---|---|
| 2,646,933 | 7/1953 | Boyce | 123/39 C |
| 2,926,895 | 3/1960 | Seyfarth | 123/39 C |
| 3,294,374 | 12/1966 | Smith | 123/39 C |
| 3,774,582 | 11/1973 | Masaki | 123/39 R |
| 3,886,917 | 6/1975 | Nakada | 123/39 R |
| 3,906,911 | 9/1975 | Nakada | 123/39 R |
| 4,011,844 | 3/1977 | Hirosawa | 123/39 R |
| 4,237,833 | 12/1980 | Des Cauriers | 123/339 |
| 4,237,838 | 12/1980 | Kinugawa | 123/339 |
| 4,321,902 | 3/1982 | Stoltman | 123/438 |
| 4,391,249 | 7/1983 | Bianchi | 123/39 R |

*Primary Examiner*—Ronald B. Cox

*Attorney, Agent, or Firm*—Stevens, Davis, Miller & Mosher

[57] ABSTRACT

A carburetor is provided which includes a sensor mounted in the engine head for monitoring cooling water temperature, and sensors for monitoring engine RPM and intake manifold absolute pressure. A first positioning unit positions the throttle valve, prior to depression of the accelerator, in a plurality of angular positions as a function of the cooling water temperature. A second positioning unit positions the choke valve as a function of the cooling water temperature to limit the amount of opening of the choke valve caused by air sucked into the carburetor by the engine. The second positioning unit has a spring for biasing the choke valve to close the choke valve to prevent swinging of the choke valve when the engine is turned off. A central processing unit receives signals from the first, second and third sensors to control the first and second positioning units to position the throttle valve and the choke valve respectively.

5 Claims, 5 Drawing Figures

CARBURETOR HAVING ELECTRONICALLY CONTROLLED ELEMENTS FOR MAINTAINING ENGINE IDLING SPEED AT A CONSTANT LEVEL AND FOR CONTROLLING CHOKE-VALVE POSITION DURING A WARM-UP PHASE

The invention relates to carburetors for internal combustion engines comprising a main barrel, a throttle-valve in the main barrel, a main fuel circuit, an idle speed circuit, and a choke-valve positioned at the inlet port of the barrel.

There are now known carburetors in which the choke-valve is closed in a static position as a function of the cooling water's temperature by means of devices provided with thermostatic elements. The thermostatic elements work also on the throttle valve to adjust the flow of the mixture into the engine as necessary.

The known carburetors of the above mentioned type have the following problems:

(a) during the engine starting phase the choke-valve swings because of the pulsations of the air sucked by the engine; this causes incorrect deliveries of fuel from the main fuel system which causes long turn-off times;

(b) antiflooding is obtained with mechanical or pneumatic elements, of the ON/0FF type, which have an immediate action on the choke for maintaining a rich mixture in the first moment of engine starting; it prevents stalling, but raises fuel consumption and pollutants;

(c) the temperature of the thermostatic elements do not correspond with the real thermic state of the engine because of heat losses along the tubes which bring the water to the housing containing the thermostatic elements; these losses change with the kind of vehicle and feel the age of the vehicle;

(d) the antiflooding elements are subject to friction, which prevents a precise correlation between the static position of the choke and the thermostatic element's temperature.

It is an object of this invention to remedy these problems. The invention as characterized below solves the problem of creating a carburetor fitted with electromechanical devices able to control the running of the engine during the warm-up phase, with an electronic central unit which controls the electromechanical devices through electric signals and with sensors which send electric signals to the electronic central unit ECU; the electromechanical devices are compact and can be assembled with little impact on the carburetor.

The advantages obtained with this invention are the following: facility in defining the static angular opening of the choke as a function of the temperature, and in obtaining a maximum value of this angular opening as a function of the temperature and of the load applied to the engine; ability to obtain a law of progressive opening of the choke, to keep present the engine's temperature and r.p.m. value.

Further objects and advantages of this invention will be apparent from the accompanying drawings and following discussion of the preferred embodiment:

Figure 1:
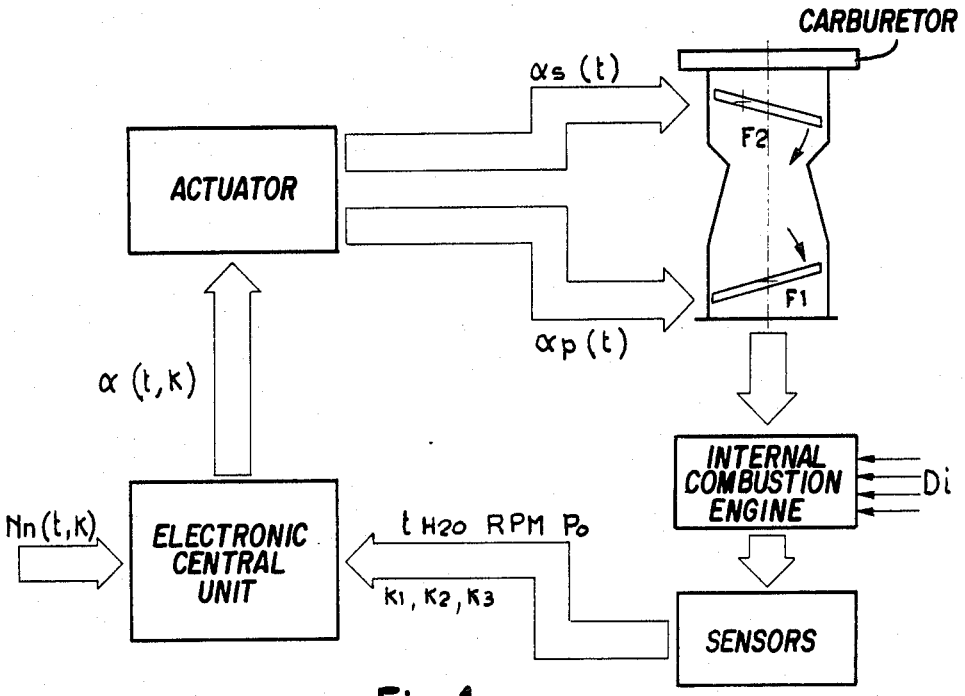
FIG. 1 is a block diagram of a command system for a carburetor of the type described in this invention.

The block diagram of FIG. 1 comprises a carburetor C, with a throttle-valve $F_1$, which regulates the flow of the mixture sucked by an internal comubstion engine M and with a choke $F_2$, that regulates the strength of the mixture during the start and the warm-up phases of the engine M. The various parameters Di which affect engine M alter the controlled variable r.p.m. from a nominal value $N_n$ and are read by a certain number of sensors, which detect the engine's speed, the absolute pressure, in the intake manifold etc., a sensor $S_1$ not shown, directly positioned in the head of the engine M, reads the water's temperature; other sensors S read the applied load to the engine, e.g., by an air conditioning system, the running condition during the accelerator-released phase, etc.

The electrical signals of the sensors S are sent to a microprocessor electornic unit center ECU, the structure of which is not relevant for the present description, and defines, for each running condition of the engine, a controlling signal of command $\alpha$ (t,k) for an actuator A, which defines two values of opening $\alpha_p$ of the throttle $F_1$ and of opening $\alpha_s$ of the choke-valve $F_2$.

Figure 3:
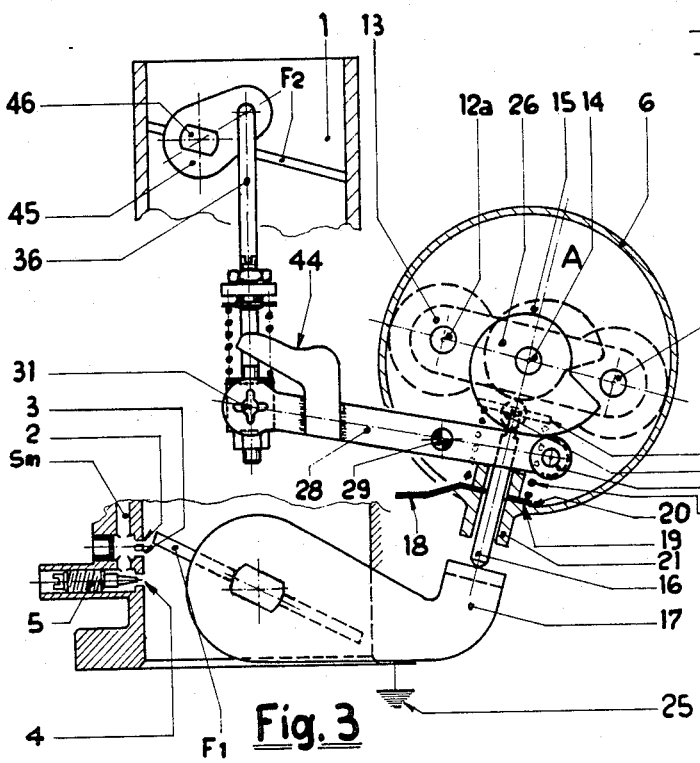
FIG. 3 shows a carburetor according to the invention illustrated in section.
Figure 5:
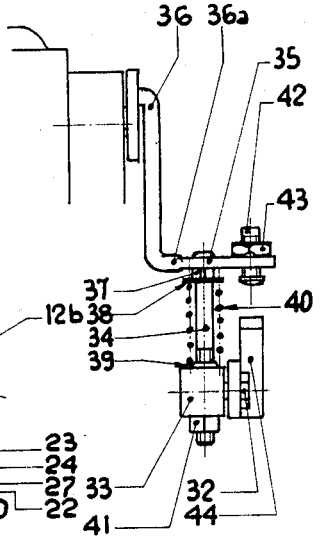
FIG. 5 shows a particular detail of the carburetor.
Figure 4:
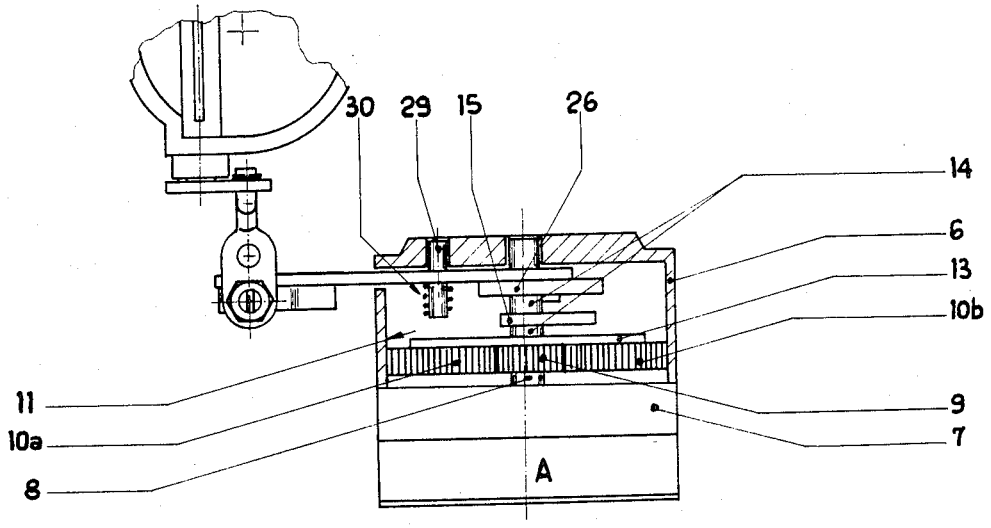
FIG. 4 shows a section of a particular detail of the said carburetor.

The carburetor shown in FIGS. 3, 4 and 5 comprise: a main barrel 1, in which opens a main fuel system of known type and not shown, an idle speed system Sm, which opens in the main barrel 1 through holes 2, 3 and 4; an idle mixture screw 5 which adjusts the outlet orifice section 4.

The actuator A of FIG. 1 is illustrated also in FIGS. 3 and 4 and consists in a cylindrical housing 6, on which a permanent magnet step motor 7 is jointed with a shaft 8; said motor 7 is electrically connected to the ECU. The unit of the cylindrical housing 6 and the motor 7 presents itself compact and with small axial size.

The shaft 8 engages with a planet wheel carrier 9, to rotate two planet wheels 10*a* and 10*b* on a crown 11; two shafts 12*a* and 12*b* (FIGS. 2 and 3), belonging to the planet wheels 10*a* and 10*b*, respectively, rotate a train carrier 13, with a shaft 14, which transmits the rotational movement to a first cam 15 able to act on a rod 16 for controlling a lever 17 and for positioning the throttle $F_1$.

The actuator A is electrically connected to the ECU by means of a reophore 18 which ends with an eye 19 which is leaned on a ring 20, made on the base of a hub 21, into the cylindrical housing 6.

On said ring 20 pushes an under end of a spring 22, the upper end of which engages on a plate 23 jointed to the rod 16 for maintaining a contact between said cam 15 and roller 24, telescopically supported on the upper end of the rod 16.

The carburetor C is electrically connected to ground 25; so the electrical connection between the actuator A and the ECU, which in FIG. 3, is schematically shown by the electrical connection between the reophore 18 and the earth 25, is obtained when the rod 16 touches the lever 17, that is in the accelerator-released condition and it is interrupted when the lever 17 is moved by the accelerator; in the first case the ECU will be informed that the engine M is entrusted to its control.

On the shaft 14 is splined a second cam 26, on which works a roller 27 placed at an extremity of a lever 28, which rotates on a pin 29; a spring 30 (FIG. 4) biases the lever 28 so to obtain the contact between the cam 26 and the roller 27.

The left extremity of the lever 28 presents a hole 31 (FIG. 3) in which is inserted a pin 32 (FIG. 5) jointed to a bush 33, in which is made an inner vertical hold, not shown, to contain our under end of a rod 34 (FIG. 5) the upper part of which is able to engage itself in a hole 35 to make integral said rod 34 with a horizontal extremity 36*a* of a rod 36.

On the rod 34 is made, e.g., by means of brazing, a stopping element 37 for a washer 38; between said washer 38 and on a ring surface 39, situated inside the said bush 33, is placed a spring 40, able to oppose at the upwards axial movements of the rod 34. The under end of rod 34 is threaded to receive an adjusting nut 41, dimensioned not to enter in the hole made in the bush 33.

In said horizontal extremity 36*a* is screwed a screw 42, supported by a nut 43 and the under end of which works with a contour 44 defined on a structure integral with the left extremity of the lever 28, for limiting the upwards axial movements of the rod 34; said contour 44 is experimentally defined to vary the width of the axial movement of the rod 34 with a law which is a function of the temperature and of the load applied to the engine.

The upper end of rod 36 rotates as a lever 45 integral with a shaft 46 of the choke $F_2$; so the contour 44 is able to vary the greatest dynamic opening of the choke $F_2$ in accordance with said law.

The nut 41 is used for recovering, in the carburetor testing phase, the free plays between the lever 28 and the cam 26 and the mechanical and geometrical losses of the spring 40 and of the cam 26.

To obtain this objective, the cam 26 is placed in a position defined for a pre-selected temperature and it is then determined whether for a pre-selected amount of air flow the choke $F_2$ arrives at a pre-established angular position.

If this angular position is not reached it is sufficient to work on the nut 41 in the right direction to place the choke $F_2$ in said angular position.

From what is shown in FIGS. 3, 4 and 5, one can deduce that the static position of the choke $F_2$ is univocally defined by the angular position of the cam 26, which univocally defines the position of the lever 28.

The position of the choke $F_2$ during the warm-up phase of the engine depends, besides on the position of the lever 28, also on the amount of the air sucked by the engine, which inclines to open said choke $F_2$ against the action of the spring 40, being the maximum opening of the choke $F_2$ limited by the contour 44, on which goes to touch the under end of the screw 42 to vary the maximum dynamic opening of the choke $F_2$ in accordance with the thermic state of the engine M.

The contours of the two cams 15 and 26 are defined and positioned so that the second cam 26 does not operate on the choke $F_2$ before cam 15 assumes the behavior explained in the Italian Patent Application No. 3341 A/82.

Figure 2:
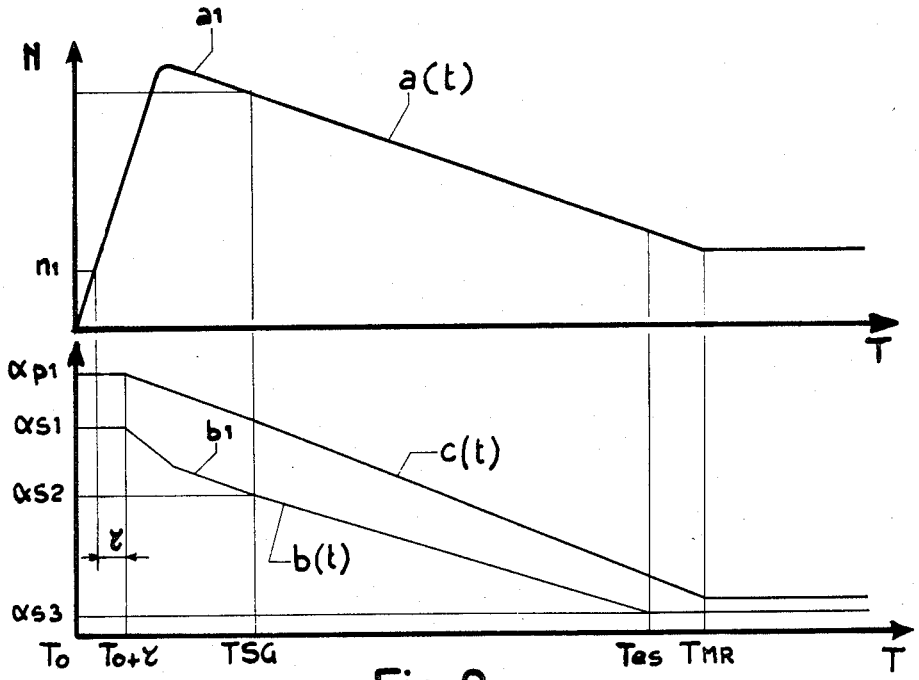
FIG. 2 is a graph that shows curves of the engine's r.p.m value; of the choke position in function of the temperature t and the time T and of the position of the throttle with accelerator released, as a function of cooling water's temperature t and of the time T.

The working of the invention can be explained referring to FIG. 2. Assume for example that the start of the engine M happens at an initial temperature $t_1 = -10°$ C. and that at the instant $T_o$ the start key is connected; the sensor $S_1$ reads the temperature $t_1$ and sends to the ECU an electrical signal which enables for commanding the actuator A, to dispose the two cams 15 and 26 in the angular positions indicated with $\alpha_p = \alpha_{p1}$ and $\alpha_s = \alpha$, respectively. The first angular position agrees with an opening of the throttle $F_1$ greater than those that the same throttle $F_1$ should have at the same temperature $t_1$ if the engine M were just started at the angular position $\alpha_{s1}$ the choke $F_2$ assumes a closed position under the pressure of the spring 40 previous biased in function of $t_1$. When the turn-off is begun at the instant $T_o$, the engine M starts in a very short time, because the spring 40 prevents the choke $F_2$ from swinging around its own shaft 46. The ECU receives information on the r.p.m. value N of the engine M from an opportune sensor and compares it with a value $n_1$ ideal for the temperature $t_1$; when $N > n_1$, the ECU knows that the engine M is started; nevertheless, it waits for a defined time T before beginning the following phase.

At the end of the time $T_o + T$, that is the instant $T_1$ begins the opening of the choke $F_2$ which continues up to the insant $T_{SG}$ at the end of which the cam 26 is in the angular position $\alpha S_2$; the antiflooding angular value $(\alpha_{si} - \alpha_{s2})$ is function of the initial temperature $t_1$; the antiflooding time $(T_{SG} - T_o)$ depends besides $t_1$, from the r.p.m. value of the engine M, because the ECU controls moment by moment, the r.p.m. value of the engine M and compares it with the nominal value n(t), memorized in a map stored in the same ECU; in said map for each value of the temperature measured by the sensor $S_1$ is defined a value n(t) of engine r.p.m. If the real r.p.m. value of the engine M $N_R$ in the moment T included in the interval time $(T_{SG} - T_o)$ becomes less than the nominal r.p.m. value n(t) for the temperature t reached at the instant T, the ECU sends to the actuator A electrical control signals, to maintain the r.p.m. value $N_R = n(t)$ and to slow down the antiflooding action. At the instant $T_{SG}$ the choke $F_2$ is opened for the angular position of the cam 26 and under the opposing effects of the air flow and of the spring 40; it is apparent that the choke $F_2$ opens itself with a progressive law, defined by the part line $b_1$ of the curve (b), to adjust moment by moment the strength of the mixture in accordance with the need of the engine M. After the instant $T_{SG}$ the curve (b) has a decreasing trend; in fact increasing the temperature t, the cam 26 is ulteriorly turned to reach an angular position $\alpha_{s3}$ for which the choke $F_2$ is completely opened; this occurs at the instant $T_{es}$ and for temperature values t lower than those usually employed, because the control of the choke $F_2$ position is combined with the control of the r.p.m. value of the engine M; this one allows to obtain lower and more controlled curves representing angular speed of the engine M than the curves obtained with the conventional carburetors and to reduce the pollutants and the fuel consumption.

The curve a of the FIG. 2 is mainly defined by the position of the throttle $F_1$; the said curve a has a rising part line, prevalently produced by the progressive heating of the engine and a descending part line, prevalently produced by the progressive closing of the throttle $F_1$, under the effect of the rotation of the cam 15. The curve a shows an over-shoot of revolutions $a_1$, compared with n(t), desired and this continues up to the instant $T_{SG}$; in the period $(T_{SG} - T_o)$, the cams 15 and 26 set up respectively the positions of the throttle $F_1$ and of the choke $F_2$ more opened and more closed relative to the necessary positions for a similar engine fed by a traditional carburetor, that also having a similar thermal state, has been started to a lower temperature. This starting system, which takes into account the initial temperature and the real r.p.m. value, allows to obtain a quick starting and a following short warm-up phase of the engine M; it allows also to render gradually optimum the positions of the throttle $F_1$ and of the choke $F_2$, taking into account the requirements of the engine M with respect to the strength of the mixture and to the r.p.m. value.

Analyzing the curve C, in the part line included between $T_o$ and $T_o+T$ this curve C is horizontal, indicating that the throttle $F_1$, positioned at the instant $T_o$ in a pre-established opening position, has not been moved. In the part line until $T_{SG}$ the curve C has a negative slope relatively easy, to allow the over-shoot part line $a_1$; subsequently the curve C keeps a nearly constant slope until the instant $T_{MR}$, in which the throttle $F_1$ reaches the idling speed position for the warm engine. One can see that the instant $T_{MR}$ is subsequent to the instant $T_{es}$; this indicates that during the time $(T_{MR}-T_{es})$ the throttle $F_1$ is more opened than during the idling speed of the warm engine, in order to prevent the stalling of the engine in the phase in which its thermic state is not stabilized and the strength of the mixture in the idling speed conditions, is defined only by the circuit Sm. One can see that the throttle $F_1$ and the choke $F_2$ are placed by the actuator A, under the control of the ECU, without any action required by the driver.

Once the starting transitory period is finished, the ECU controls the idling speed as happened in the invention relative to the Italian Patent Application No. 3341 A/82.

We claim:

1. A carburetor for an internal combustion engine, for maintaining an idling speed of said engine at a constant level and for controlling a position of a choke valve associated with said carburetor during an engine warm-up phase, said carburetor comprising:

(a) a main barrel;
(b) a throttle valve;
(c) idle speed circuit control means;
(d) a choke valve;
(e) a primary fuel circuit opening into said barrel between said throttle valve and said choke valve;
(f) first sensor means disposed in an engine head of said engine for monitoring cooling water temperature of cooling water associated with said engine and for providing signals indicating said cooling water temperature;
(g) second sensor means for monitoring engine RPM and for providing signals indicating said RPM;
(h) third sensor means for monitoring intake manifold absolute pressure and for providing signals indicating said pressure;
(i) first positioning means for positioning said throttle valve when an accelerator of said engine is in a non-depressed rest position, in a plurality of angular positions as a function of said cooling water temperature;
(j) second positioning means for positioning said choke valve as a function of said cooling water temperature to limit an amount of opening of said choke valve caused by air sucked into said carburetor by said engine, said second positioning means including elastic means for biasing said choke valve by an amount of force required to close said choke valve to prevent pivoting of said choke valve when said engine is turned off;
(k) a central processing unit receiving signals from said first, second and third sensors for controlling said first and second positioning means to position said throttle valve and said choke valve respectively; and
(l) said second positioning means including;
  (i) a step motor;
  (ii) a first cam rotatably controlled by said step motor;
  (iii) a choke valve shaft on which said choke valve is mounted;
  (iv) a second lever connected to said choke valve shaft to pivot therewith;
  (v) first rod means having one end connected to said second lever such that when said second lever pivots with said choke valve shaft said end of said first rod means pivots therewith;
  (vi) a first lever pivotable about an axis interposed between said first rod means and said first cam, said first lever having one end contacting a contour of said first cam and another end pivotably connected to an end of said first rod means;
  (vii) said elastic means including a spring tending to bias said first rod means to oppose action by air sucked by said engine which tends to open said check valve; and
  (viii) a member disposed on an end of said first lever, having a contour shaped for limiting downward axial movement of said first rod means to position said choke valve in predetermined positions as a function of said cooling water temperature, whereby a predetermined angular position of said first cam determines a static position of said choke valve.

2. The carburetor as in claim 1, further comprising an epicyclic train associated with said step motor for rotating said first cam and wherein said first positioning means comprises a second cam rotatably controlled by said epicyclic train, said second cam for positioning said throttle valve in said plurality of angular positions.

3. The apparatus as in claim 2, wherein said first and second cams are rotatably mounted on a same shaft.

4. The apparatus as in claim 2, wherein said first cam has a contour such that said first cam opens said choke valve at a first said cooling water temperature and said second cam has a contour such that such second cam positions said throttle valve in an idling speed position when a steady state temperature of said cooling water is reached, said first temperature being less than said steady state temperature.

5. The apparatus as in claim 2, wherein said first and second cams are rotatably mounted on different separately controlled shafts.

* * * * *